US006993833B2

(12) United States Patent
Inada et al.

(10) Patent No.: US 6,993,833 B2
(45) Date of Patent: Feb. 7, 2006

(54) APPARATUS FOR MANUFACTURING SUB-HARNESS

(75) Inventors: Takashi Inada, Okayama (JP); Koji Kaneda, Okayama (JP); Yasushi Taniguchi, Okayama (JP); Masashi Fujino, Okayama (JP); Fusatoshi Araki, Okayama (JP); Toyokazu Machida, Okayama (JP)

(73) Assignee: Yazaki Corporation, Tokyo (JP)

( * ) Notice: Subject to any disclaimer, the term of this patent is extended or adjusted under 35 U.S.C. 154(b) by 229 days.

(21) Appl. No.: 10/755,340

(22) Filed: Jan. 13, 2004

(65) Prior Publication Data

US 2004/0139606 A1 Jul. 22, 2004

(30) Foreign Application Priority Data

Jan. 14, 2003 (JP) ..... 2003-005922

(51) Int. Cl.
*H01B 43/00* (2006.01)

(52) U.S. Cl. ..... 29/748; 29/753; 29/754; 29/755

(58) Field of Classification Search ..... 29/825, 29/748, 753, 754, 721, 720, 747
See application file for complete search history.

(56) References Cited

U.S. PATENT DOCUMENTS

| | | | | |
|---|---|---|---|---|
| 3,913,203 A | * | 10/1975 | Gardini et al. | 29/714 |
| 5,477,606 A | * | 12/1995 | Igura | 29/721 |
| 5,590,457 A | * | 1/1997 | Ninchi | 29/721 |
| 5,680,672 A | * | 10/1997 | Baumann | 15/312.1 |
| 6,195,884 B1 | * | 3/2001 | Miyamoto et al. | 29/857 |

FOREIGN PATENT DOCUMENTS

| | | |
|---|---|---|
| JP | 63-96818 | 4/1988 |
| JP | 02-024914 | 1/1990 |
| JP | 5-92976 | 12/1993 |
| JP | 07-169550 | 7/1995 |
| JP | 7-235799 | 9/1995 |
| JP | 8-162249 | 6/1996 |
| JP | 08-180923 | 7/1996 |
| JP | 09-167670 | 6/1997 |
| JP | 09-167671 | 6/1997 |
| JP | 2000-133385 | 5/2000 |
| JP | 2001-034375 | 2/2001 |

* cited by examiner

*Primary Examiner*—Carl J. Arbes
(74) *Attorney, Agent, or Firm*—Armstrong, Kratz, Quintos, Hanson & Brooks, LLP

(57) ABSTRACT

A method for manufacturing a sub-harness comprises the steps of:

holding a first connector housing in a guiding device for terminal insertion;

holding a second connector housing in a continuity check tool;

bringing a terminal at a first end of an electric wire with terminals at the both ends thereof into contact with a touch contact to make a specified light emitter of light emitters in the guiding device emit, said touch contact being connected to the guiding device via a main control device, said touch contact having a curved contact surface;

inserting the terminal at the first end into a specified terminal-receiving chamber of terminal-receiving chambers in the first connector housing to bring the terminal at the first end into contact with a specified terminal contact of terminal contacts in the guiding device, said specified chamber being illuminated by said light emitter; and checking continuity between terminals at the first end and at a second end of the electric wire with a continuity check control device which is connected to the continuity check tool and the specified terminal contact, said terminal at the second end having been inserted into the second connector housing.

8 Claims, 7 Drawing Sheets

APPARATUS FOR MANUFACTURING SUB-HARNESS

BACKGROUND OF THE INVENTION

1. Field of the Invention

This invention relates to an apparatus and a method for manufacturing sub-harness efficiently by guiding a terminal to a specified terminal-receiving chamber of a connector housing and checking continuity of an electric wire with terminals concurrently.

2. Description of the Related Art

A wire harness, which is a group of electric wires arranged in a vehicle, is formed by combining a plurality of sub-harnesses. The sub-harness is composed of a plurality of electric wires, terminals each of which is crimped at one end or both ends of the each electric wire, and the connector housing made of synthetic resin, into which the terminals are inserted. The way to crimp the terminal is, firstly to strip an end part of a sheath of the electric wire off, secondly in a state that a lead wire of the wire is exposed, to crimp-contact a crimping piece at a front side of the terminal to the lead wire, and to crimp-fix a crimping piece at a rear side of the terminal to the sheath of the electric wire. The electric wire with terminals is formed by crimping the terminals onto the electric wire.

A worker inserts and fits the terminal crimped onto the electric wire into the terminal-receiving chamber of the connector housing. The terminal is locked by a resilient locking lance in the terminal-locking chamber so as not to slip out of the terminal-receiving chamber. The connector is composed of the connector housing and the terminals. Recently, with the multi-circuit design and the space saving design of the assembly, many connectors are considerably miniaturized, and many terminal-receiving chambers are formed in a multistage in a connector housing of the connector. Moreover, with diversification of circuits, variety of connectors is increased.

It is very difficult for the worker to insert the terminal into the specified terminal-receiving chamber of such a connector housing. In Japanese Patent Application Laid-open 2000-133385 (page 3, FIG. 1), the applicant of this invention formerly disclosed an apparatus to prevent incorrect terminal insertion, as a means for a worker, not limited to skilled worker, to insert easily and correctly a specified terminal into a corresponding terminal-receiving chamber. When the worker holds the terminal and a terminal of a connector housing receptacle by hand, said apparatus teaches a position into which the terminal is to be inserted, by illuminating the specified receiving chamber with a light emitter. However, in such a conventional apparatus to prevent incorrect terminal insertion, since the terminal is held by worker's hand, it is feared that the terminal becomes easy to oxidize. Additionally, in the conventional apparatus, although the terminal is inserted into the specified terminal-receiving chamber reliably, after the insertion of the terminal, continuity of the electric wire with terminals should be checked in another process. Therefore, there is a problem that manufacturing the sub-harness takes much time.

SUMMARY OF THE INVENTION

Accordingly, in view of the problems described above, it is an object of this invention to provide an apparatus and a method for manufacturing a sub-harness, whereby the sub-harness is manufactured without a terminal being touched by hand, and continuity of the electric wire is checked effectively to reduce man-hours required to manufacture the sub-harness.

For attaining the object, an apparatus for manufacturing sub-harness of this invention comprises:

a guiding device for terminal insertion, on which a first connector housing being held, said guiding device having light emitters for illuminating respective terminal-receiving chambers of the first connector housing and terminal contacts for contacting respective terminals inside the terminal-receiving chamber;

a touch contact for contacting a terminal at a first end of an electric wire with terminals at the both ends thereof, said terminal being inserted into the first connector housing;

a main control device for electrically connecting the touch contact with the respective light emitters;

a continuity check control device connected to the terminal contact; and a continuity check tool, on which a second connector housing is held, electrically connecting the terminal at the first end with a terminal at a second end of the electric wire via the continuity check control device.

According to the composition described above, by the touch contact touching the terminal at the first end of the electric wire, the light emitter illuminates the terminal-receiving chamber of the first connector housing, so that the worker can insert the terminal at the first end into the illuminated terminal-receiving chamber correctly. Therefore, since the terminal at the first end is not touched by hand, oxidation of the terminal at the first end is prevented. Further, the terminal at the first end is inserted to the first connector housing and the first terminal contacts the terminal contact inside the guiding device concurrently, so that the continuity between the terminal at the first end and the terminal at the second end, namely, the continuity of the electric wire via terminals at both ends is checked by the continuity check control device. Thus, the man-hours required to manufacture the sub-harness is reduced.

For attaining the object of this invention, another apparatus for manufacturing sub-harness of this invention comprises:

a first guiding device for terminal insertion on which a first connector housing being held, said guiding device having light emitters for illuminating respective terminal-receiving chambers of the first connector housing and terminal contacts for contacting respective terminals in the terminal-receiving chamber;

a second guiding device for terminal insertion, on which a second connector housing is held, said guiding device having light emitters for illuminating respective terminal-receiving chambers of the second connector housing and terminal contacts for contacting respective terminals inside the terminal-receiving chamber;

a touch contact for contacting a terminal of an electric wire with terminals at both ends thereof, said terminal being inserted into the first or the second connector housing;

a main control device for electrically connecting the touch contact with the respective light emitters; and a continuity check control device connected to the terminal contact.

According to the composition described above, each terminal at each end of the electric wire is inserted into each connector housing at the same process to improve efficiency of the terminal insertion work. Said terminals are inserted correctly according to the guidance of the light emitter, and at the same time, continuity of the electric wire is checked. Thus, the efficiency of manufacturing sub-harness is increased.

Preferably, in the apparatuses for manufacturing sub-harness described above, the continuity check control device and the main control device are connected to each other, and when the continuity of the electric wire is bad, the main control device does not power next light emitter.

According to the composition described above, when detecting that the continuity of the electric wire is bad, production of the sub-harness is suspended at the same time to prevent reliably the defective products in process with bad continuity from being sent to next process.

Preferably, in the apparatuses for manufacturing sub-harness described above, the touch contact includes a contact surface in a curved shape.

According to this composition, the terminal can be brought into contact with the touch contact from every direction easily and reliably, and since a surface of the touch contact is smooth, the terminal is prevented from being damaged or deformed.

In the above apparatuses for manufacturing sub-harness, preferably, light emitters are provided at respective receiving cylinders, which receive the electric wires with terminals by type of the electric wires, the light emitters are connected to the main control device respectively, and an emission of a specific light emitter of the light emitters indicates the type of the electric wire specified to be selected.

According to this composition, the specified electric wire with terminals can be selected unmistakably to prevent a wrong combination of the terminals and uneven wire length. Thus, quality of the sub harness is improved.

For attaining the object of this invention, a method for manufacturing sub-harness comprises the steps of:

holding a first connector housing in a guiding device for terminal insertion;

holding a second connector housing in a continuity check tool;

bringing a terminal at a first end of an electric wire with terminals at the both ends thereof into contact with a touch contact to make a specified light emitter of light emitters in the guiding device emit, said touch contact being connected to the guiding device via a main control device;

inserting the terminal at the first end into a specified terminal-receiving chamber of terminal-receiving chambers in the first connector housing to bring the terminal at the first end into contact with a specified terminal contact of terminal contacts in the guiding device, said chamber being illuminated by said light emitter; and checking continuity between terminals at the first end and a second end of the electric wire with a continuity check control device which is connected to both the continuity check tool and the specified terminal contact, said terminal at the second end having been inserted into a second connector housing.

According to the composition described above, by bringing the terminal at the first end of the electric wire into contact with the touch contact, the specific terminal-receiving chamber of the first connector housing is illuminated by the specified light emitter, so that an worker can correctly insert the terminal at the first end into the illuminated terminal-receiving chamber. In this case, since the terminal has no need to be held by hand, oxidation of the terminal is prevented. Further, the terminal at the first end is inserted into the first connector housing and contacting the terminal contact inside the guiding device at the same time, then the continuity between the terminal at the first end and the terminal at the second end, namely, the continuity of the electric wire with terminals is checked by the continuity check control device. Thus, the man-hours for manufacturing the sub-harness are reduced.

For attaining the object of this invention, another method for manufacturing sub-harness comprises the steps of:

holding a first connector housing in a first guiding device for terminal insertion;

holding a second connector housing in a second guiding device for terminal insertion;

bringing a terminal at a first end or a second end of an electric wire with terminals at both ends thereof into contact with a touch contact to make a specified light emitter of light emitters in the guiding devices emit, said touch contact being connected to the guiding devices via a main control device;

inserting the terminal into a specific terminal-receiving chamber of terminal-receiving chambers in the connector housing to bring said terminal into contact with a specified terminal contact of terminal contacts in the guiding device, said specified terminal-receiving chamber being illuminated by said emitting light emitter; and checking continuity between the terminals at the first end and the second end of the electric wire by a continuity check control device connected to the terminal contact.

According to this composition, terminals at both ends of the electric wire can be inserted into respective connector housings by the same process, so that the efficiency of the terminal insertion work can improve. The terminals are inserted correctly with the guiding light of the specified light emitter. Then, the terminals are inserted into the respective connector housings, and the continuity of the wire with terminals is checked at the same time. Thus, the efficiency of manufacturing sub-harness improves.

Preferably, in said methods of manufacturing sub-harness, further comprising the steps of:

connecting the continuity check control device and the main control device to each other;

checking the continuity of said wire with terminals; and stopping powering the next light emitter by the main control device when the continuity is checked bad.

According to the composition described above, when a continuity error of the electric wire with terminals is detected, production of the sub-harness is suspended at the same time to prevent reliably the defective products in process with bad continuity from being sent to next process.

Preferably, in the methods described above for manufacturing sub-harness, further comprising the steps of:

providing light emitters at respective receiving cylinders, said receiving cylinders receiving the electric wires with terminals by type of the electric wires;

connecting the light emitters to the main control device respectively; and indicating the type of the electric wire specified to be selected by an emission of a specified light emitter of the light emitters.

According to this composition, the specified electric wire with terminals can be selected unmistakably to prevent a wrong combination of the terminals and uneven wire length. Thus, quality of the sub harness is improved.

DESCRIPTION OF THE PREFERRED EMBODIMENT

One embodiment of this invention will now be described below with reference to figures.

Figure 1:
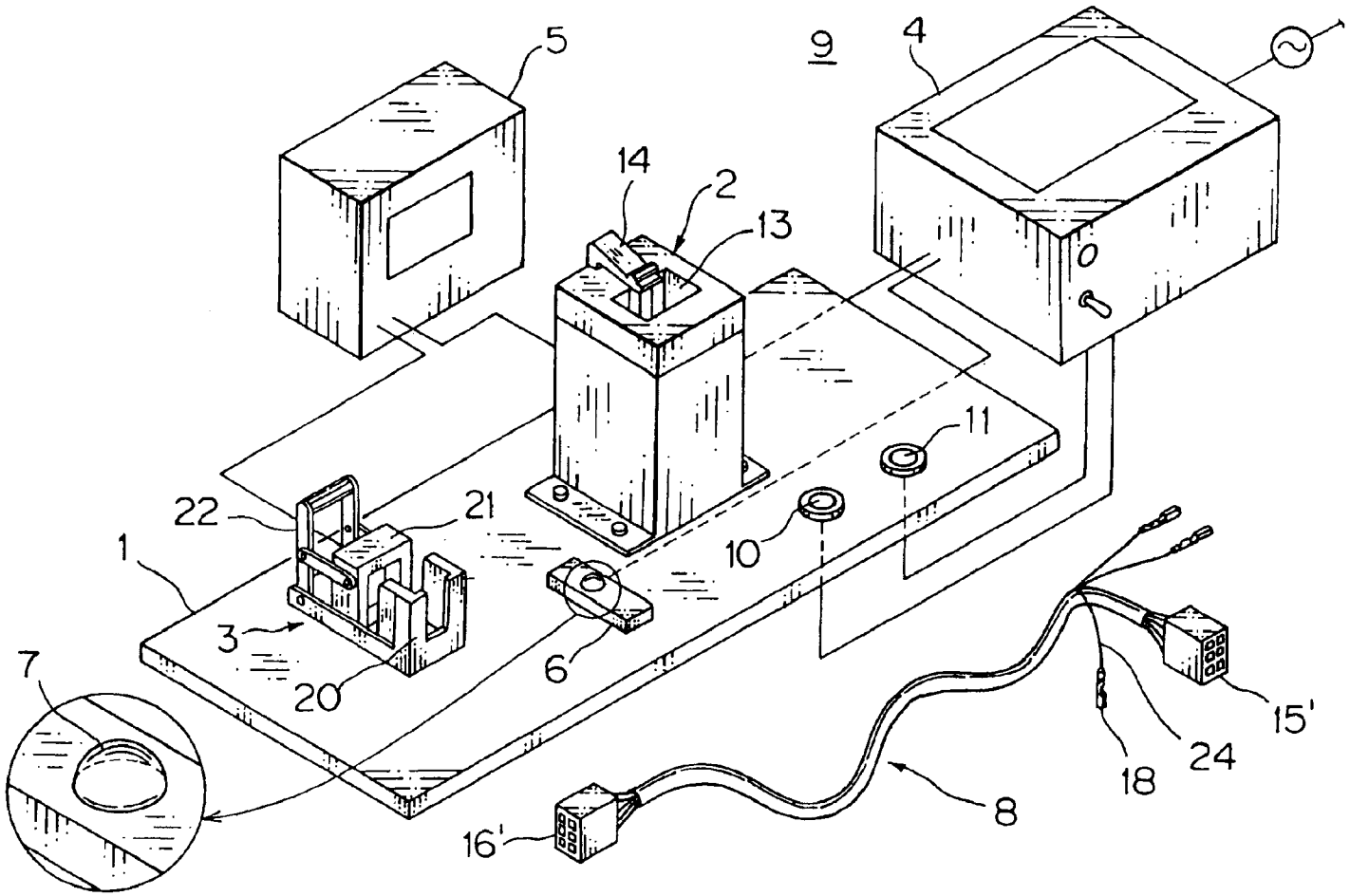
FIG. 1 is a perspective view showing a first embodiment of an apparatus and a method for manufacturing sub-harness according to this invention.
Figure 2:
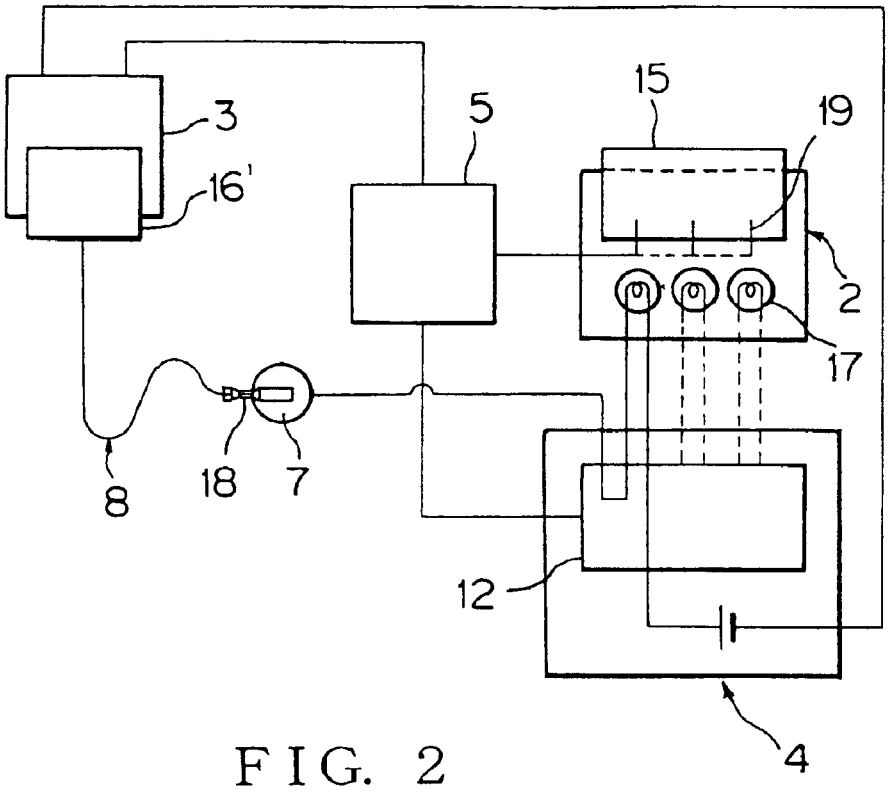
FIG. 2 is a schematic circuit view of the apparatus for manufacturing sub-harness of the first embodiment.

FIGS. 1 to 6 show a first embodiment of an apparatus and a method for manufacturing sub-harness according to this invention. In FIG. 1, reference number 1 corresponds to a workbench for both terminal insertion and continuity check. Each of reference numbers 2, 3 corresponds to a guiding device for terminal insertion and a continuity check tool on the workbench 1. Similarly, each of reference numbers 3, 4, and 5 corresponds to a continuity check tool, a main control device, and a continuity check control device. Reference number 6 corresponds to a guide starter including a touch contact 7. Reference number 8 corresponds to one embodiment of sub-harness. The apparatus for manufacturing sub-harness 9 is composed of at least a guiding device for terminal insertion 2, a continuity check tool 3, a main control device 4, a continuity check control device 5, and a guide starter 6. A start button 10 and a completion button 11 are provided on the workbench 1 in addition to the guiding device for terminal insertion 2, the continuity check tool 3 and the guide starter 6. Each of buttons 10, 11 is connected to the main control device 4. In addition, as shown in FIG. 2, the guiding device for terminal insertion 2 is connected to the main control device 4, the touch contact 7 of the guide starter 6 is connected to the guiding device for terminal insertion 2 via the main control device 4, the guiding device for terminal insertion 2 is connected to the continuity check tool 3 via the continuity check control device 5, and the continuity check control device 5 is connected to the main control device 4. In FIG. 2, reference numeral 12 corresponds to a control unit of the main control device 4.

The guiding device for terminal insertion 2 includes an insertion hole as a holding unit 13 and a locking unit 14 (locking lever) facing the insertion hole. As shown in FIG. 2, light emitting diodes as light emitters 17 and terminal contacts 19 for contacting terminals 18 (shown in FIG. 3), said terminals 18 being inserted into the connector housing 15, are arranged in the holding unit 13, corresponding to respective numbers and positions of terminal-receiving chambers in one of the connector housings 15 (also shown in FIG. 3) of the sub-harness 8. Each terminal contact 19 is connected to the continuity check control device 5.

The main control device 4 includes capabilities of storing and designating model numbers of the sub-harness 8 (shown in FIG. 1), storing each position of terminals 18 at each model number (each number of the terminal-receiving chambers corresponding to each terminal 18), making the light emitter 17 at specified terminal-receiving chamber emit in conjunction with the guide starter 6, and not making the light emitter 17 at next turn emit unless receiving a signal from the continuity check control device 5 indicating that the continuity of the wire at this turn is good. All the numbers of terminal-receiving chambers, each of which indicates each specified connection between each terminal-receiving chambers of the first connector housing 15 and the second connector housing 16 connected by electric wire with terminals 24 of the sub-harness 8, are memorized in the main control device 4. As shown in FIG. 1, the continuity check tool 3 includes a holding unit 20 for holding a connector, a detecting unit 21 for detecting continuity, and a lever 22 for pushing slidably the detecting unit 21 to the holding unit 20. The detecting unit 21 receives a probe pin as a terminal contact (not shown), and the probe pin is connected to the continuity check control device 5.

Figure 3:
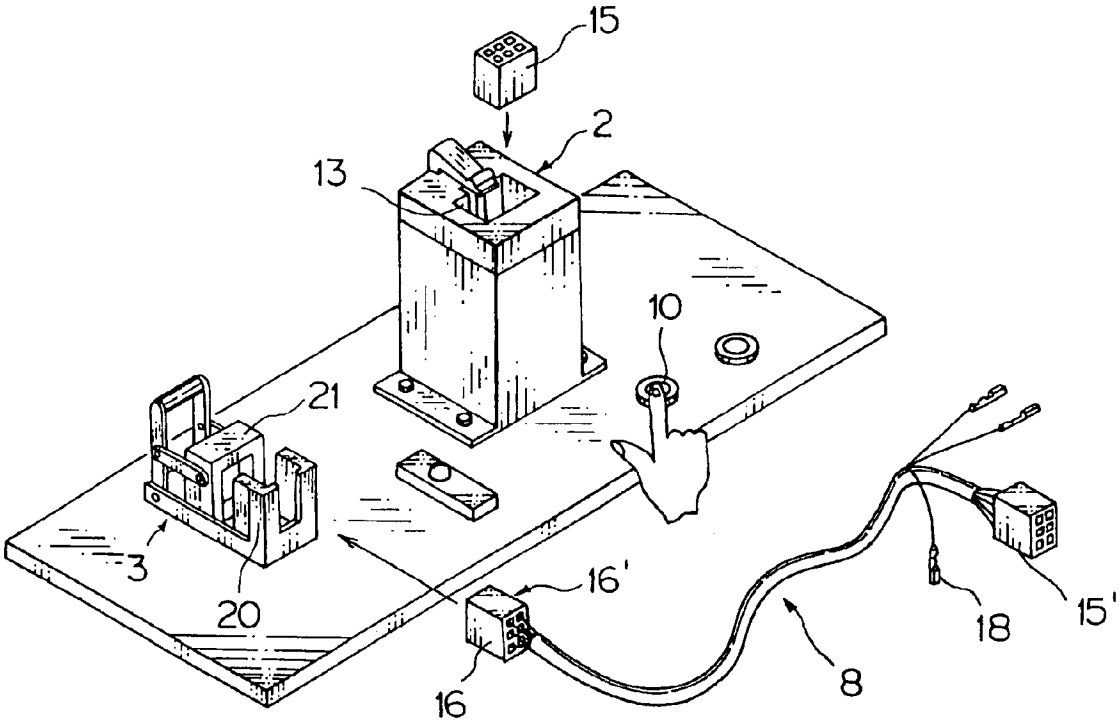
FIG. 3 is a perspective view showing a state of a connector housing being held in the apparatus for manufacturing sub-harness.

As shown in FIG. 3, the second connector 16 of the sub-harness 8 is held in the holding unit 20 of the continuity check tool 3, and the connector housing 15, for composing a first connector 15' of the sub-harness 8, is held in the holding unit 13 of the guiding device for terminal insertion 2. In this embodiment, two connectors 15' are provided at one side of the sub-harness 8. Of course, other embodiments are acceptable, for example, each of a first connector 15' and a first connector 16' is provided at each side of one sub-harness 8, or each of a plurality of connectors 15' and a plurality of connectors 16' are provided at each side.

The second connector 16' has already received terminals. The connector 16' is composed of the connector housing 16 and the terminals. The probe pins (not shown) in the detecting unit 21 contact the respective terminals of the second connector 16'. After holding the second connector 16' and the first connector housing 15, by pushing the start button 10, the guiding device for terminal insertion 2 and the continuity check control device 5 become ready to operate.

Figure 5:
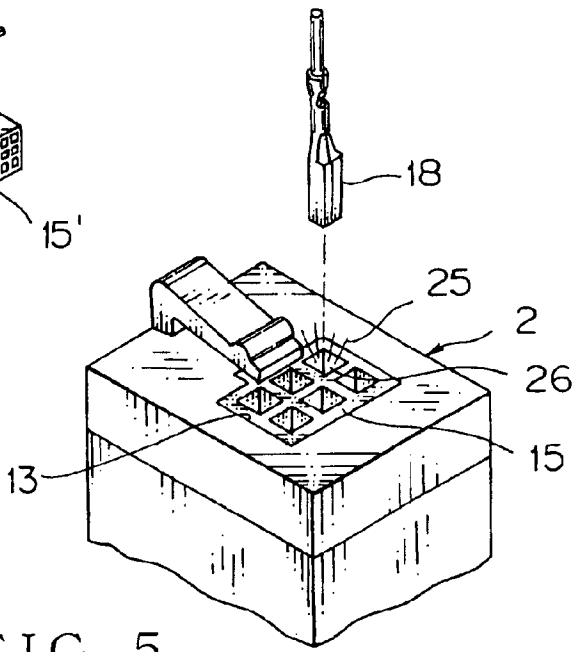
FIG. 5 is a perspective view showing a state of the terminal about to being inserted into a connector housing of a guiding device for terminal insertion.
Figure 4A:
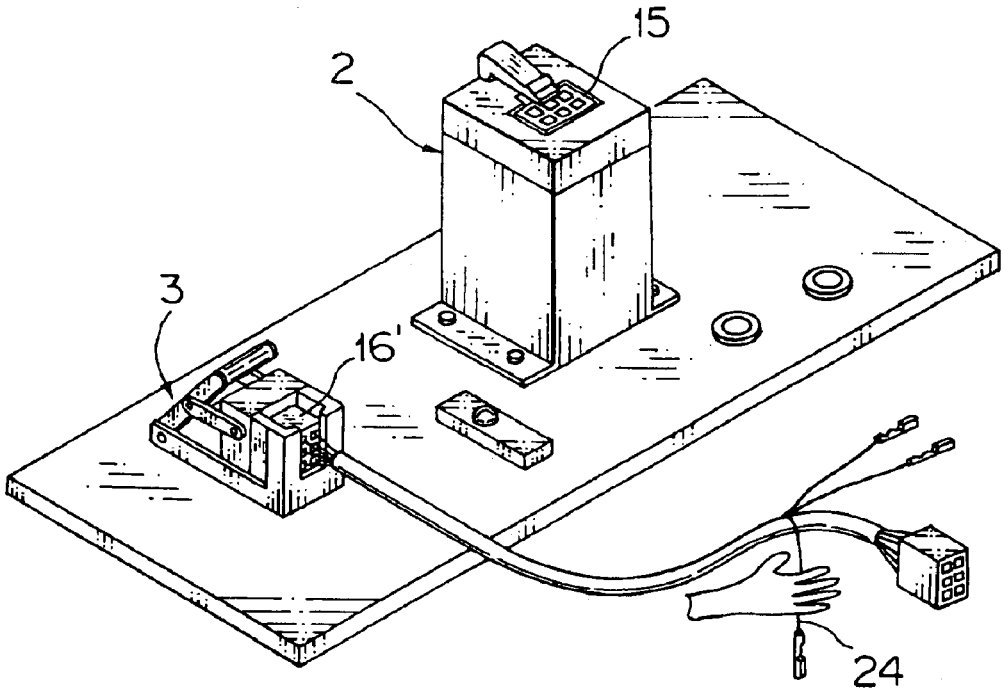
FIG. 4A is a perspective view showing a state of a connector being held in a continuity check tool.
Figure 4B:
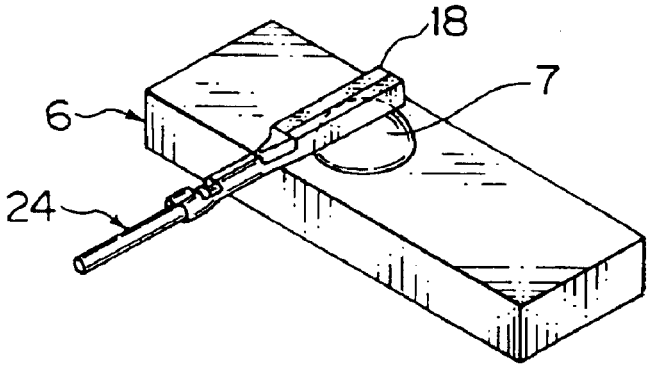
FIG. 4B is a perspective view showing a state of a terminal, which is at an end of an electric wire extending from the connector, contacting with a touch contact.

In FIG. 1, the guide starter 6 is characterized by having a touch contact 7 in an almost hemisphere, and as shown in FIG. 4, one of the terminals at the first end 18 of the sub-harness 8 contacts the touch contact 7. Namely, during holding a sheath part of the electric wire with terminals 24 by hand, the worker brings an end of the optional terminal 18 into contact with the hemispherical touch contact. The touch contact 7 is formed with a curved contact surface. In addition, as other embodiments of the touch contact 7, a leg can be provided on the touch contact to arrange the touch contact in the same height as the guiding device for terminal insertion 2, or the touch contact can be provided on an upper surface of the guiding device for terminal insertion 2. Since the worker has no need to contact the terminals 18, oxidation or contamination of the terminals 18 are prevented. Further, since the touch contact 7 projects in a hemispherical shape, the terminals 18 can brought into contact with the touch contact 7 from every direction easily and reliably, so that the contact operation is easy. Further, since the touch contact 7 is in a curved shape and has a smooth surface, the terminals 18 are prevented from being damaged or deformed. As shown in FIG. 5, by bringing one of the terminals 18 into contact with the touch contact 7, the specified light emitter 17 (FIG. 2) of the holding unit 13 of the guiding device for terminal insertion 2 lights or blinks (as shown by reference number 25) to illuminate the terminal-receiving chamber 26, which is specified to receive the terminal 18, from the bottom of the connector housing 15 of the sub-harness 8. The worker inserts the terminal 18 downward into the illuminated terminal-receiving chamber 26.

As shown in FIG. 2, after inserting the terminal 18 into the connector housing 15, the terminal 18 contacts the terminal contact 19 inside the guiding device for terminal insertion 2, and continuity between the terminal inside the second connector 16' at the continuity check tool 3 and the other terminal 18 inside the connector housing 15 at the guiding device for terminal insertion 2 is checked via the continuity check control device 5. When the continuity check result is not good (hereafter referred to as "NG"), the main control device 4 operates in order not to guide the next terminal in conjunction with a warning lamp and a warning buzzer.

Figure 6:
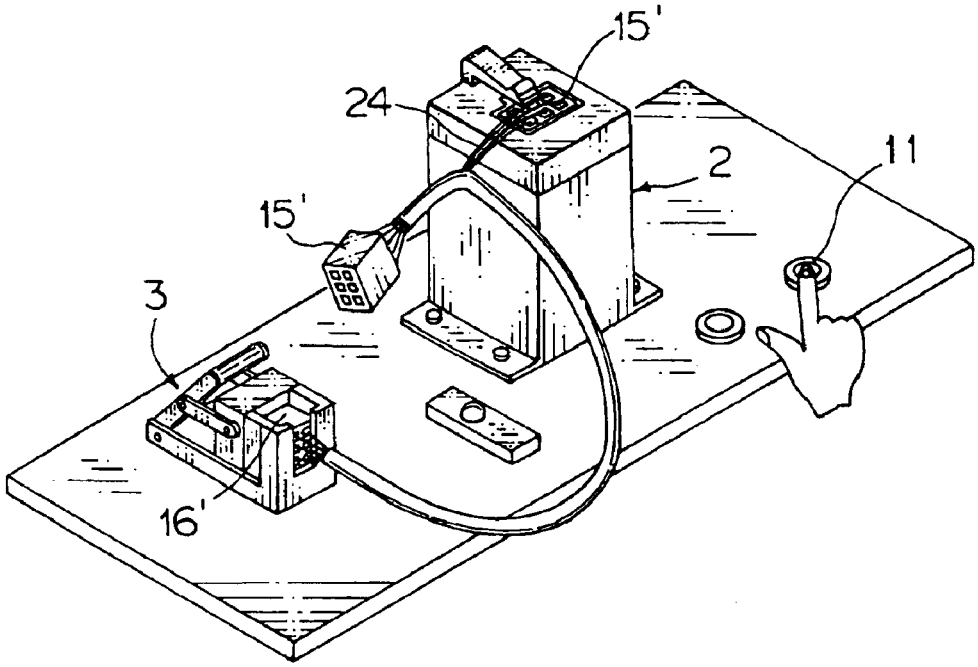
FIG. 6 is a perspective view showing a state of the terminal having been inserted into the connector housing.

When the continuity check result is good, by receiving the signal, the main control device 4 allows the next light emitter 17 to emit. Accordingly, by bringing the next terminal 18 into contact with the touch contact 7, the terminal-receiving chamber 26 being specified to receive said terminal 18 is illuminated. By repeating these operations, all the terminals 18 are correctly inserted into the specified terminal-receiving chambers 26 respectively. After all the terminals are inserted, as shown in FIG. 6, the worker pushes the completion button 11. If all the operations are completed, the number of productions is counted up, otherwise, if some operations remain, a warning buzzer sounds. After confirming a completion buzzer, the worker takes the sub-harness 8 out. In FIG. 6, the sub-harness 8 having two connectors 15' at the first end and one connector 16 at the second end is formed. As described above, by checking the continuity of the electric wire with terminals 24 and guiding the terminal 18 at the same time, the sub-harness 8 is manufactured efficiently and correctly in a short time.

By the way, before assembling the first connector 15', the second connector 16' is assembled by inserting the terminals at the second ends (not shown) of the electric wire 24 into the connector housing 16 using the guiding device for terminal insertion 2.

FIG. 7 to 13 show an apparatus and a method as a second embodiment that include the steps from selecting electric wire with terminals 24 to assembling the completed sub-harness 8, by applying the apparatus and method for manufacturing the apparatus for manufacturing sub-harness 9 in FIG. 1 to 6. Detailed explanations for the same components as described in the first embodiment are omitted. Instead, reference numbers of said components in the second embodiment are common to those in the first embodiment.

Figure 7:
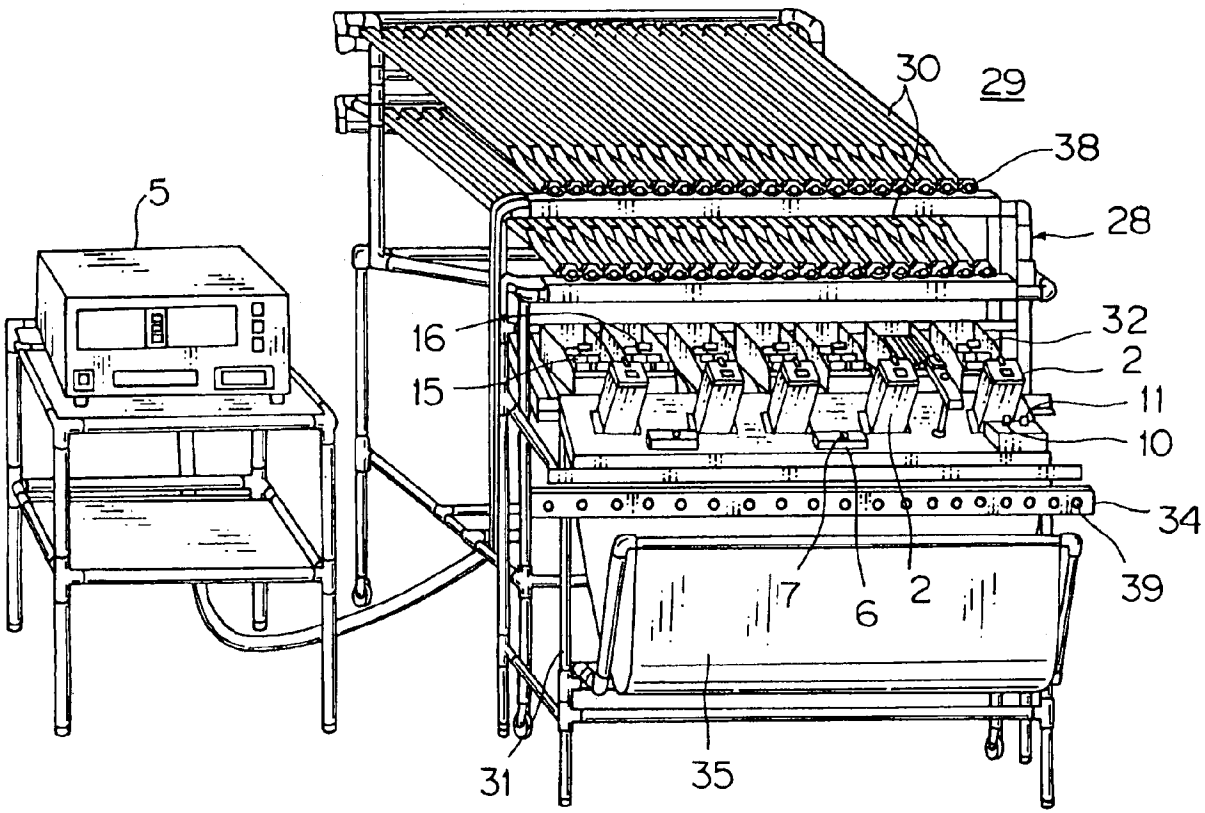
FIG. 7 is a perspective view showing a second embodiment of an apparatus and a method for manufacturing sub-harness according to this invention.

FIG. 7 shows a general view of an apparatus 29 for manufacturing sub-harness including a shelf 28 for holding electric wire. Said shelf 28 for holding electric wire is formed by arranging a plurality of receiving cylinders 30 in a plurality of stages (two stages in this embodiment). A sub-shelf 31 is provided in front of the shelf 28. A plurality of parts cases 32 are arranged in a line on the sub-shelf 31. A plurality of devices 2 for guiding insertion of terminals and checking continuity of an electric wire are arranged in a line in front of the parts cases 32, said device being substantially the same as the guiding device for terminal insertion in the first embodiment. A rail 34 for disposing a sub-harness setting rod 33 (shown in FIG. 13) is provided in front of the guiding and checking device 2.

Figure 13:
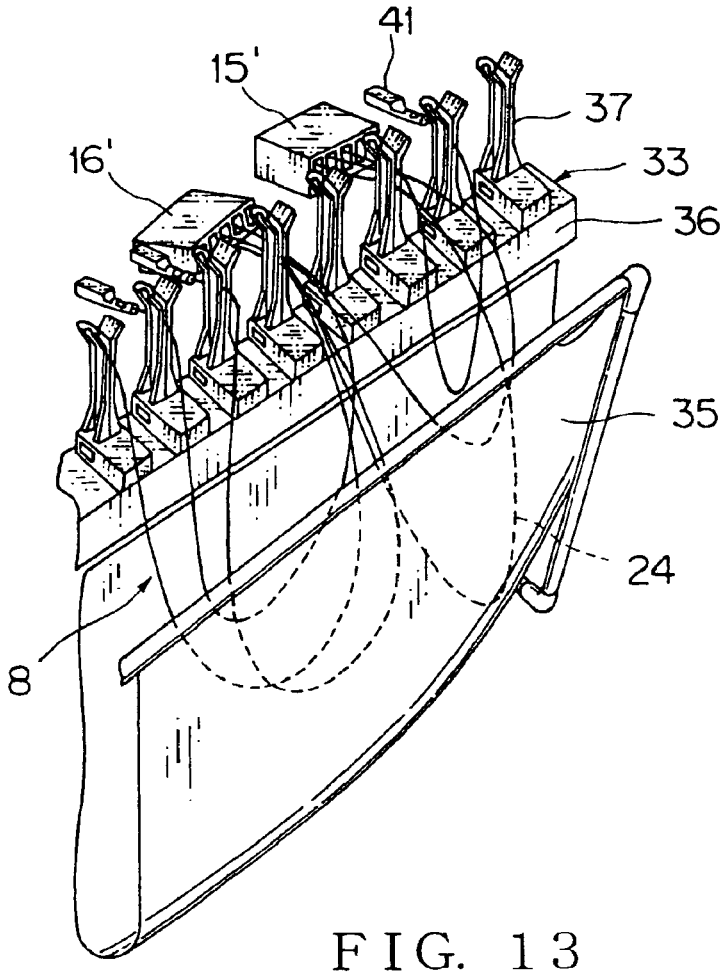
FIG. 13 is a perspective view showing a state of the sub-harness being held in a sub-harness setting rod.

In FIG. 7, reference number 6 indicates a guide starter having the hemispherical shaped touch contact 7, and reference numbers 10, 11 indicate switches of start and completion respectively. As shown in FIG. 13, a sheet cover 35 for covering the electric wire with terminals 24 is provided in front of the sub-shelf 31. A continuity check control device 5 and a main control device (corresponding to reference number 4 in the first embodiment) are provided at a side of the shelf 28.

The receiving cylinders 30 receive various types of electric wires with terminals 24 according to respective types. The parts cases 32 receive various types of connector housings 15, 16, protective tubings, and the like according to respective types. As shown in FIG. 13, the sub-harness setting rod 33 is formed by standing a plurality of clamps 37 on a horizontal rectangular bar 36. Each clamps 37 is composed of a pair of electric wire clips.

Figure 10:
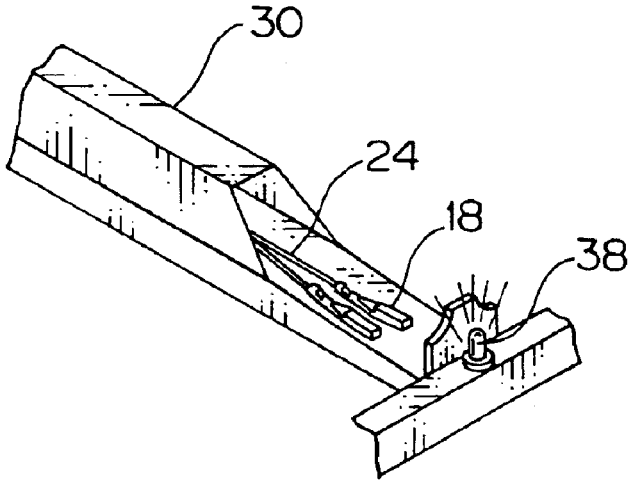
FIG. 10 is a perspective view showing an emitting light emitter of a receiving cylinder.

In FIG. 7, light emitting diodes as a light emitters 38 shown in FIG. 10 are arranged at respective front ends of the receiving cylinders 30. Another light emitters 39 are arranged in a line on the rail 34 corresponding to respective clamps 37 on the sub-harness setting rod 33 as shown in FIG. 13. In this embodiment, instead of using the continuity check tool 3 shown in FIG. 1, by connecting a plurality of guiding and checking devices 2 with each other, continuity of both ends of terminals of the electric wire 24 can be checked via two of the guiding and checking device 2.

Figure 8:
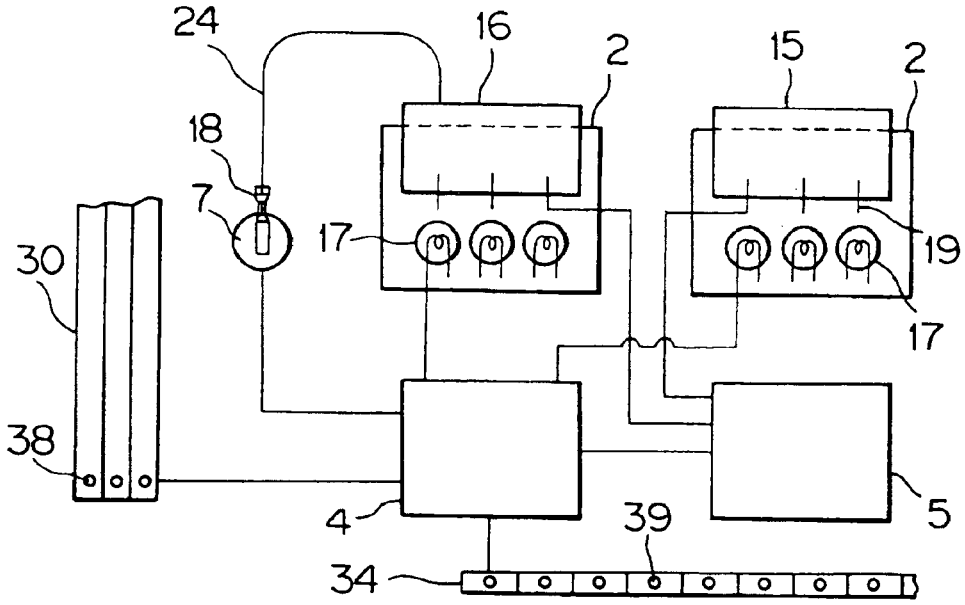
FIG. 8 is a schematic circuit view of the apparatus for manufacturing sub-harness of the second embodiment.

As a schematic circuit diagram of the apparatus 29 shown in FIG. 8, the light emitters 38 in front of the receiving cylinders 30 and the light emitters 39 on the rail 34 corresponding to respective clamps 37 of the sub-harness setting rod 33 are respectively connected to the main control device 4, and respectively emit or blink according to signals from the main control device 4. Further, each light emitter 17 of each guiding and checking device 2 is connected to the main control device 4. Each terminal contact 19 of each guiding and checking device 2 is connected to the continuity check control device 5. The main control device 4 and the continuity check control device 5 are connected to each other. The hemispherical touch contact 7 of the guide starter 6 is connected to the main control device 4. As shown in FIG. 7, the start and completion buttons 10, 11 are connected to the main control device 4.

The main control device 4 includes at least a function to make the light emitter 17 of the guiding and checking device 2 emit in response to a signal from the touch contact 7 of the guide starter 6, and a function to make the light emitter 38 of the receiving cylinders 30 emit in response to a signal from the continuity check control device 5.

Figure 9:
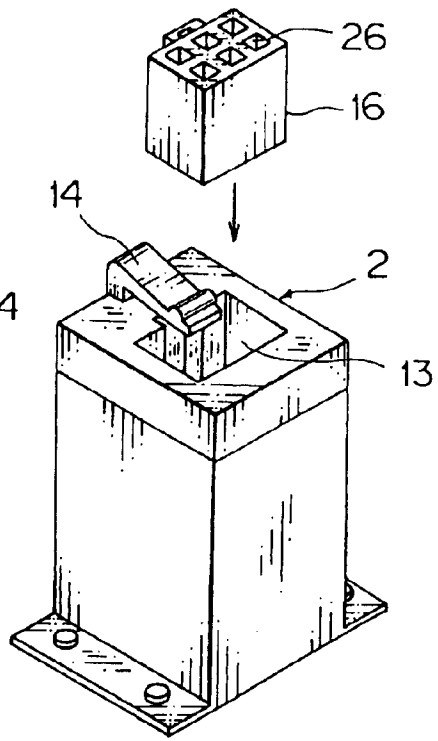
FIG. 9 is a perspective view showing a state of the connector housing being held into a device for both terminal insertion guiding and continuity check control.

The worker pushes the start button 10 shown in FIG. 7, and takes the connector housing 15 (or 16) out of the specified parts cases 32. Then, as shown in FIG. 9, the worker inserts the first connector housing 16 (corresponding to the second connector housing in the first embodiment) into the holding unit 13 (insertion hole) of the specified guiding and checking device 2 and holds the first connector housing 16 thereon to fix the first connector housing 16 with a locking lever 14.

At this time, it is possible that a specified light emitter (not shown) emits or blinks to indicate the specified holding unit 13 of the guiding and checking device 2 or the specified parts case 32 for the worker according to a command of the main control device 4, after the main control device 4 receives a start signal from the start button 10. It is also possible that after the connector housing 15 is taken out of the parts cases 32, by pushing a confirmation button (not shown), the main control device 4 makes the specified light emitter blink in order to indicate the specified guiding and checking device 2, in which the connector housing 16 is to be held. It is also possible that when other parts such as a protective tubing except the connector housing are taken out of the parts cases 32, the main control device 4 make the specified light emitter blink to indicate the specified electric wire with terminals 24 to be attached to, by pushing the confirmation button.

Upon holding the connector housing 16 in the guiding and checking device 2, the terminal contacts 19 (in FIG. 8) at bottom side of the holding unit 13 are arranged to respective terminal-receiving chambers 26 (in FIG. 9) of the connector housing 16. When the connector housing 16 is male and receives the female terminals 18 (shown in FIG. 11), the terminal contacts 19 moved forward and held in the terminal-receiving chamber 26. When the connector housing is female (not shown) and receives male terminals (not shown), the terminal contacts 19 moves forward and held in a connector engaging chamber, which is communicated to the terminal-receiving chamber. Each terminal contact 19 may be elastic and spring-urged in a sliding manner such as a probe pin.

After holding the connector housing 16, as shown in FIG. 10, the worker takes the electric wire with terminals 24 out of the electric wire receiving cylinder 30 in which the corresponding light emitter 38 is emitting. The light emitters 38 of the respective receiving cylinders 30 emit respectively in response to the signal of the main control device 4 according to the start button 10 (shown in FIG. 7). Otherwise, after holding the connector housing 16, by pushing a confirmation switch (not shown), the specific light emitter 38 may emit via the main control device 4.

Figure 11:
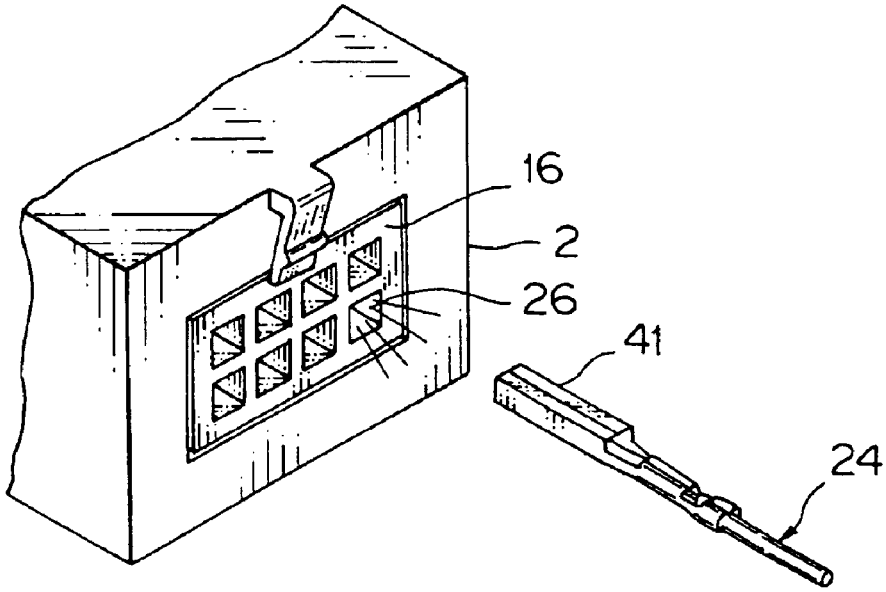
FIG. 11 is a perspective view showing a state of the terminal being inserted into the connector housing of the device for both terminal insertion guiding and continuity check control.

Next, as shown in FIG. 11, a terminal 41 at the first end of the electric wire with terminals 24 (corresponding to the terminal at the second end in the first embodiment) is inserted into the specified terminal-receiving chamber 26 of the connector housing 16, said chamber being illuminated by the specified light emitter 17 (FIG. 8) of the guiding and checking device 2. This light emitter 17 emits in response to the signal from the main control device 4 in conjunction with emission of the light emitter 38 of the receiving cylinders 30 according to the start button 10.

Figure 12:
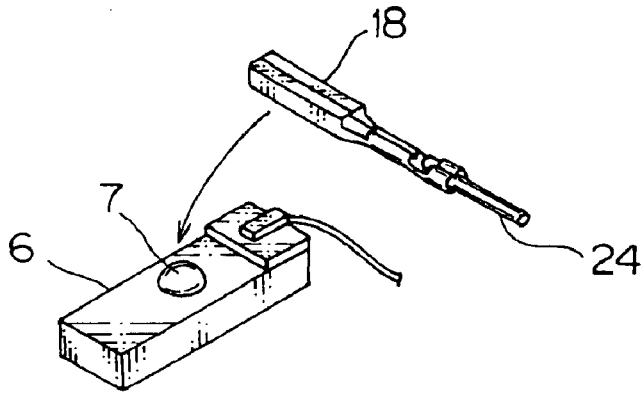
FIG. 12 is a perspective view showing a state of the terminal contacting with the touch contact.

After inserting the terminal 41 at the one end, as shown in FIG. 12, the worker brings the terminal 18 at the second end of the electric wire with terminals 24 (corresponding to the terminal at the first end in the first embodiment) into contact with the touch contact 7 of the guide starter 6. According to above, the specified light emitter 17 of the same or other guiding and checking device 2 emits, and the worker inserts the terminal at the second end 18 into the specified terminal-receiving chamber 26 of the second connector housing 15 (corresponding to the first connector housing in the first embodiment), said terminal-receiving chamber 26 being illuminated by the light emitter 17. The specified light emitter 17 emits according to the command of the main control device 4 in response to the signal from the touch contact 7.

Thus, terminals 18, 41 at both ends of the electric wire with terminals 24 are firstly inserted into the terminal-receiving chambers 26 of the connector housing 15, 16 of respective guiding and checking devices 2, secondly brought into contact with the respective terminal contacts 19 (shown in FIG. 8) at bottom sides of respective holding units 13, thirdly connected to the continuity check control device 5 via the respective terminal contacts 19, and fourthly the electric wire with terminals 24 is checked continuity by the continuity check control device 5.

When the continuity is good, the main control device 4 makes the specified light emitter 38 (FIG. 9) of the specified electric wire receiving cylinder 30 (FIG. 7) having the next electric wire with terminals 24 in response to the signal indicating that the continuity is good. When the continuity is not good, a warning lamp and a warning buzzer warn, and the main control device 4 command not to take out the next electric wire with terminals 24 in response to the signal indicating that the continuity is not good. Thus, outflow of defective products is prevented reliably. In addition, it is possible that said two terminals 18, 41 may be inserted into the same connector housing (15 or 16) of the same guiding and checking device 2. In this case, the continuity is checked as well as above.

In the above case, terminals 18, 41 at the both ends of the electric wire with terminals 24 are inserted into the connector housings 15, 16. When only the terminal 41 at the first end of the electric wire with terminals 24 is inserted into the connector housing 16, and the terminal 18 at the second end is left without being inserted, for the sake of option and the like, firstly, the worker inserts the terminal 41 at the first end into the specified connector housing 16 with a guide of the emitting light emitter 17 as shown in FIG. 11. Secondly, the specified light emitter 39 in FIG. 7 corresponding to the specified clamps 37 of the sub-harness setting rod 33 in FIG. 13 emits. Thirdly, the worker makes the illuminated clamps 37 pinch and keep the electric wire with terminals 24 near the terminal 18 at the second end. As shown in FIG. 12, a signal is generated by bringing the terminal 18 at the second side into contact with the touch contact 7, and the main control device 4 responds to the signal by making the light emitter 39 at the clamps side emit. Of course, by previous input operation, the main control device 4 previously stores the relations between the positions (numbers) of the terminal-receiving chambers in the connector housings 15, 16 and terminals 18, 41 of the electric wire with terminals 24, and whether the respective terminals 18, 41 are specified to be inserted or not (open). In addition, when positions of the clamps 37 of the sub-harness setting rod 33 (FIG. 13) are not needed to be specified, the light emitters 39 at respective clamps 37 sides are not needed to be provided.

In FIG. 13, when clamped, the electric wire with terminals 24 is curved inside a wire protector 35 and protected from outside interference. After clamping the electric wire with terminals 24, by pushing the confirmation button, the main control device 4 makes the specified electric wire receiving cylinder 30 (FIG. 7) illuminated to indicate that said cylinder 30 holds the next electric wire with terminals 24. Alternatively, by bringing the terminal 18 at the second end into contact with the touch contact 7 (FIG. 12), the electric wire receiving cylinder 30, which holds the next electric wire with terminals 24, is illuminated.

By repeating above operations, all the terminals 18, 41 of the electric wire with terminals 24 are inserted into respective specified terminal-receiving chambers 26 of the specified connector housings 15, 16. After insertions are completed, the worker removes the connectors 15', 16' from the guiding and checking device 2, and as shown in FIG. 13, the specified clamps 37 clamp the electric wire with terminals 24 at the connector side.

After completing all the operations, the worker pushes the completion button 11 (FIG. 7), removes the sub-harness setting rod 33 (FIG. 13) holding the sub-harness 8 from the rail 34 (FIG. 7), and holds the next sub-harness setting rod 33 on the rail 34. By repeating above operations, each sub-harness setting rod 33 holds a plurality of sub-harnesses 8. For example, one wire harness (not shown) may be composed of a plurality of sub-harnesses 8 on the one sub-harness setting rod 33.

As shown in FIG. 11, after the terminal 41 is inserted into the connector housing 16, by pulling the electric wire with terminals 24 in a reverse direction of terminal insertion, the worker checks the engagement of the terminal 41. However, when the worker pulls the terminal by hand, variations in pulling force are produced. Therefore, for example, a spring type wire terminal pull tester (not shown) is provided at the guiding and checking device 2, and a switch for detecting a stroke of the tester is also provided. By receiving "on" signal from the switch, namely the terminal is checked to be satisfactorily pulled, the main control device 4 may instructs the worker to take the next electric wire with terminals 24 out from the electric wire receiving tube 30.

Moreover, it is acceptable that the shelf 28 (FIG. 7) for holding electric wire is provided at the apparatus of the first embodiment shown in FIG. 1 to 6 in order to select a specified electric wire with terminals 24 by an emission of the specified light emitter 38 on each electric wire receiving cylinder 30.

What is claimed is:

1. An apparatus for manufacturing sub-harness comprising:

a guiding device for terminal insertion, on which a first connector housing being held, said guiding device having light emitters for illuminating respective terminal-receiving chambers of the first connector housing and terminal contacts for contacting respective terminals inside the terminal-receiving chamber;

a touch contact for contacting a terminal at a first end of an electric wire with terminals at the both ends thereof, said terminal being inserted into the first connector housing;

a main control device for electrically connecting the touch contact with the respective light emitters;

a continuity check control device connected to the terminal contact; and a continuity check tool, on which a second connector housing is held, electrically connecting the terminal at the first end with a terminal at a second end of the electric wire via the continuity check control device.

2. An apparatus for manufacturing sub-harness comprising:

a first guiding device for terminal insertion on which a first connector housing being held, said guiding device having light emitters for illuminating respective terminal-receiving chambers of the first connector housing and terminal contacts for contacting respective terminals in the terminal-receiving chamber;

a second guiding device for terminal insertion, on which a second connector housing is held, said guiding device having light emitters for illuminating respective terminal-receiving chambers of the second connector housing and terminal contacts for contacting respective terminals inside the terminal-receiving chamber;

a touch contact for contacting a terminal of an electric wire with terminals at both ends thereof, said terminal being inserted into the first or the second connector housing;

a main control device for electrically connecting the touch contact with the respective light emitters; and a continuity check control device connected to the terminal contact.

3. The apparatus for manufacturing sub-harness as claimed in claim 1, wherein the continuity check control device and the main control device are connected to each other, and when continuity of the electric wire is bad, the main control device does not power the next light emitter.

4. The apparatus for manufacturing sub-harness as claimed in claim 2, wherein the continuity check control device and the main control device are connected to each other, and when the continuity of the electric wire is bad, the main control device does not power the next light emitter.

5. The apparatus for manufacturing sub-harness as claimed in claim 1, wherein the touch contact includes a contact surface in a curved shape.

6. The apparatus for manufacturing sub-harness as claimed in claim 2, wherein the touch contact includes a contact surface in a curved shape.

7. The apparatus for manufacturing sub-harness as claimed in claim 1, wherein light emitters are provided at respective receiving cylinders, which receive the electric wires with terminals by type of the electric wires, the light emitters are connected to the main control device respectively, and an emission of a specified light emitter of the light emitters indicates the type of the electric wire specified to be selected.

8. The apparatus for manufacturing sub-harness as claimed in claim 2, wherein light emitters are provided at respective receiving cylinders, which receive the electric wires with terminals by type of the electric wires, the light emitters are connected to the main control device respectively, and an emission of a specified light emitter of the tight emitters indicates the type of the electric wire specified to be selected.

* * * * *